US005713085A

United States Patent [19]

Enns

[11] Patent Number: 5,713,085

[45] Date of Patent: Feb. 3, 1998

[54] PATIO POND

[75] Inventor: Douglas Brent Enns, Plano, Tex.

[73] Assignee: Beckett Corporation, Dallas, Tex.

[21] Appl. No.: 562,880

[22] Filed: Nov. 27, 1995

[51] Int. Cl.[6] ..... E04H 4/04

[52] U.S. Cl. ..... 4/506; 4/513; 52/169.7; 52/586.2

[58] Field of Search ..... 4/488, 494, 506, 4/513, 541.1, 541.2, 541.3, 541.4, 541.5; 52/169.7, 586.1, 586.2, 300; 472/126

[56] References Cited

U.S. PATENT DOCUMENTS

| | | | |
|---|---|---|---|
| D. 267,271 | 12/1982 | Kingsley et al. | D24/38 |
| 727,862 | 5/1903 | Taylor | 52/586.1 |
| 1,617,527 | 2/1927 | Knight | 52/586.2 |
| 2,363,405 | 11/1944 | Eichelberger | 20/4 |
| 2,392,551 | 1/1946 | Roe | 52/586.2 |
| 3,020,560 | 2/1962 | Bedick | 4/506 |
| 3,233,251 | 2/1966 | Barrera | 4/506 |
| 3,276,043 | 10/1966 | Delia | 4/172 |
| 3,317,927 | 5/1967 | Shields | 4/506 |
| 3,902,291 | 9/1975 | Zucht | 52/300 |
| 4,020,509 | 5/1977 | West | 52/169.7 |
| 4,223,498 | 9/1980 | Ventrice | 52/249 |
| 5,161,264 | 11/1992 | Dugas | 4/488 |
| 5,425,144 | 6/1995 | Cornelius | 4/488 |

*Primary Examiner*—Henry J. Recla
*Assistant Examiner*—Charles R. Eloshway
*Attorney, Agent, or Firm*—Sidley & Austin

[57] ABSTRACT

A patio pond (10, 60) is formed by a bottom (12) of boards (22) with notches (32) formed in their upper surfaces, a wall (14) formed of a plurality of square panels (40) fit into the notches in the boards of the base, a flexible water tight membrane (18) which is fit over the upper edges of the square panels (40) and a top (16) formed of a plurality of boards (34) having notches (38) formed in their lower surfaces to fit over the membrane and upper edges of the panels to complete construction of the patio pond. The membrane (18) defines an enclosed volume (20) to be filled with water. The top, bottom and walls of the pond support the force of the water without the need to use any fasteners whatsoever.

10 Claims, 3 Drawing Sheets

PATIO POND

TECHNICAL FIELD OF THE INVENTION

This invention relates to a decorative above-ground pond.

BACKGROUND OF THE INVENTION

Many people would enjoy having a pond on their property to stock with fish, water lilies or just to enjoy the presence of a body of water. However, space constraints and cost constraints limit the ability of most people to accomplish this. An in-ground pool or pond typically requires considerable excavation to form an enclosed volume for the pond and the use of a liner to prevent water from draining away.

The need exists for an inexpensive, easily constructed pond to provide the advantages thereof. The pond should occupy a minimum space in order to install the pond in a restricted space.

SUMMARY OF THE INVENTION

An above ground pond for holding water is disclosed. The pool has a base formed of a plurality of boards secured end to end to define an enclosed perimeter. Each of the boards has an upper surface with a notch formed therein. A top is provided which is formed of a plurality of boards secured end to end to define an enclosed perimeter. Each of the boards in the top has a lower surface with a notch formed therein. A wall is provided which is formed by a plurality of panels having a lower end and an upper end. The lower end of each panel is received in the notch of a board in the base while the upper end of each panel is received in the notch in a board in the top. A flexible, waterproof membrane is engaged between the upper end of each of the panels and the notch in the boards in the top about the enclosed perimeter and extends along the inside surface of the panels to form an enclosed volume to receive water. No fasteners are used in the pond and only a hammer is needed to construct the pond.

In accordance with another aspect of the present invention, the wall can further include vertical boards secured between the base and the top. In accordance with another aspect of the present invention, the boards of both the base and top can be secured end to end by tapered keys.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figure 1:
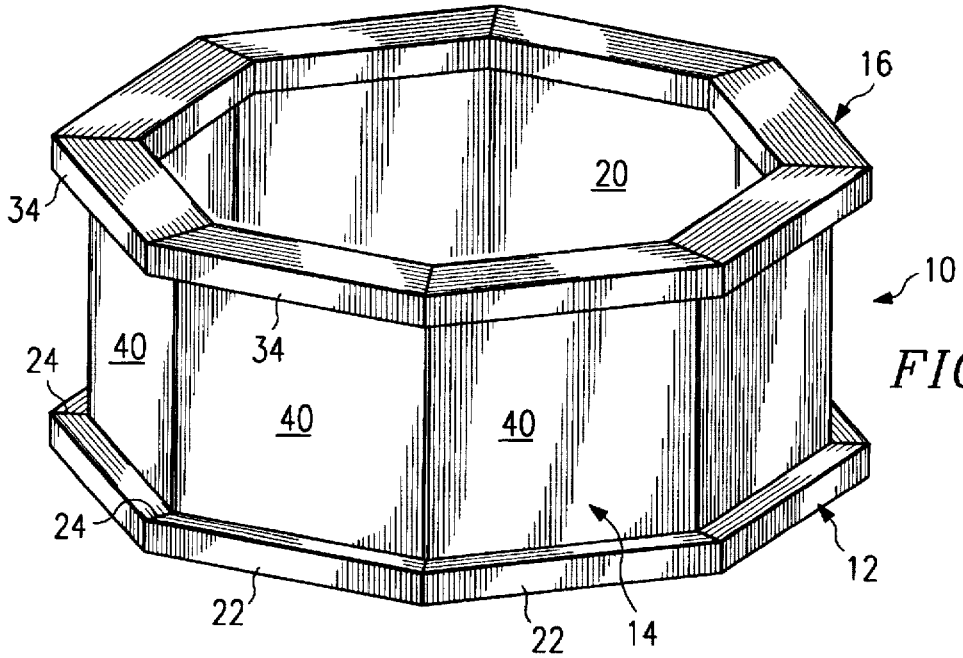
FIG. 1 is a perspective view of a patio pond forming a first embodiment of the present invention.
Figure 3:
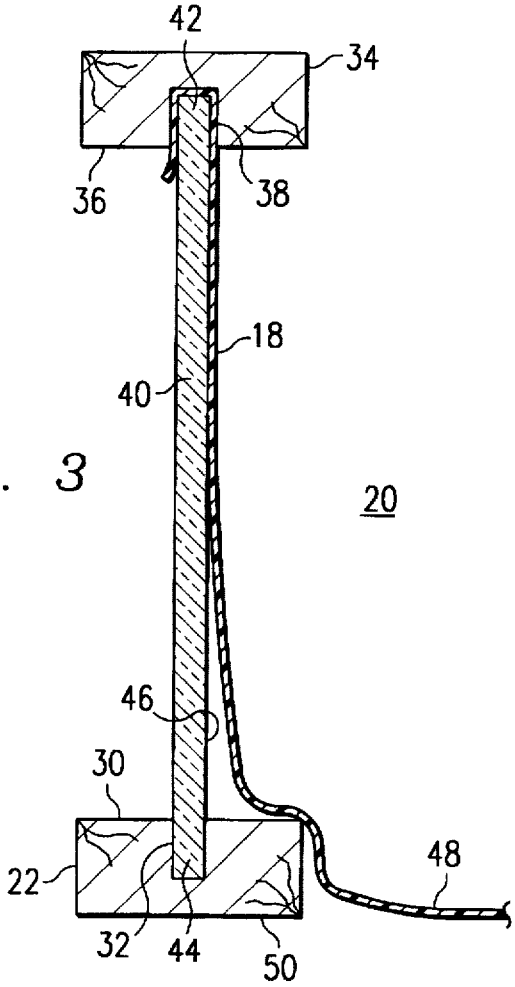
FIG. 3 is a vertical cross-sectional view of the patio pond illustrating the mounting of the flexible membrane between the top and wall formed by the tiles.
Figure 2:
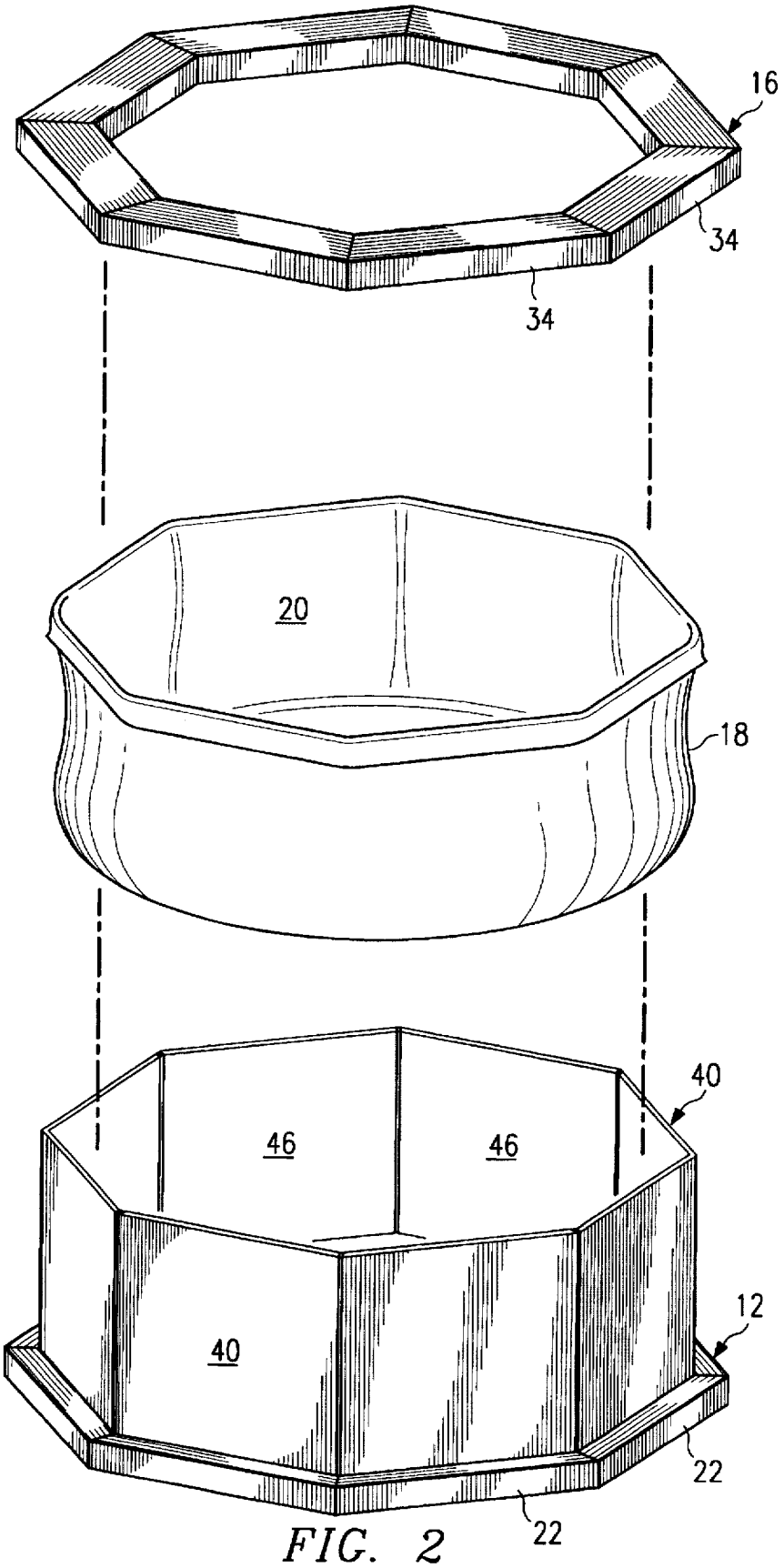
FIG. 2 is an exploded view of the patio pond illustrating its construction.

With reference now to FIGS. 1–3, a patio pond 10 forming a first embodiment of the present invention is illustrated. The pond 10 includes a bottom 12, wall 14 and top 16. A flexible membrane 18 is secured at the top 16 and forms an enclosed water tight volume 20 to hold water to form a pond. As will be discussed hereinafter, the construction of the patio pond allows use of common materials to reduce construction costs and provides ready assembly so that an unskilled purchaser can assemble the patio pond with little difficulty.

Figure 5:
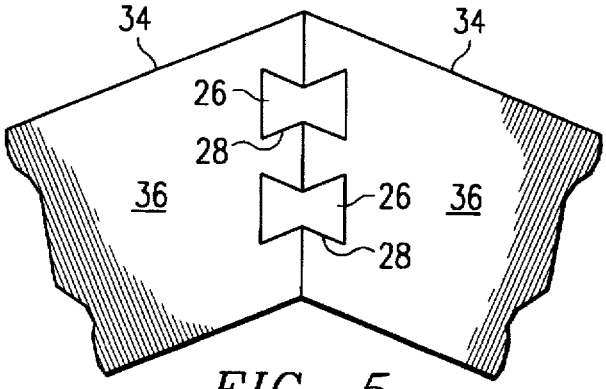
FIG. 5 is an illustrative view of abutting boards secured together by tapered keys.

With reference to FIGS. 1–3, the bottom 12 can be seen to be formed of a series of boards 22 secured end to end to form a complete enclosed periphery. In the design illustrated in FIGS. 1–3, eight boards 22 are used to form an octagonal structure. The ends 24 of the boards 22 are mitered at the necessary angle so that the boards can be secured end to end to form the entire periphery. The boards are preferably held together by dovetail shaped tapered plastic or wood keys 26 which fit between wedge shaped tapered notches 28 in adjacent ends of mating boards as seen in FIG. 5. Preferably, two tapered keys 26 are used at each joint, as seen in FIG. 5. These tapered keys are of the type made and distributed by Hoffman Machine Company, Inc. of 1593 Locust Avenue, Bohemia, N.Y. 11716-2162 and sold as Hoffman Keys. However, similar keys are available from other sources and can be used instead.

The upper surface 30 of each of the boards 22 lies in a common plane and a notch 32 is formed into the upper surface of each board 22, which extends along its entire length, as best seen in FIG. 3.

The top 16 is also formed of a plurality of boards 34 and, preferably, is almost identically constructed to the bottom 12. With top 16, the lower surface 36 of each of the boards 34 lies in a common plane and a notch 38 is formed through the lower surface 36 of each of the boards 34 and extends the entire length of each board 34. As can be understood, the top 16 can be constructed almost identically to the bottom 12, but simply inverted. This reduces the manufacturing cost by permitting uniformity of parts.

The wall 14 is formed of a series of square panels 40, preferably ceramic tiles. The panels 40 have a uniform thickness, as best seen in FIG. 3, with an upper edge 42 and a lower edge 44. As can be seen in FIG. 3, the upper edge 42 of a panel is inserted within the notch 38 of a board 34 while the lower edge 44 of the panel is received in the notch 32 of the board 22 in the bottom. While the panels 40 can be secured to the boards 22 and 34 by any desired fastener, such as glue, screws, nails or the like, the panels 40 are preferably received by the boards to form a sufficiently tight engagement without any fasteners at all. As such, the notches 32 and 38 are deep enough and yet narrow enough to tightly engage the edges of the panels 40.

The flexible membrane 18, as seen in FIG. 3, is preferably secured in the notches 38 of the boards 34 on the top 16 between the upper edge 42 of the square panels 40 and the boards 34 along the entire enclosed periphery of the top. The membrane 18 is sufficiently large to extend downward along the inner surfaces 46 of the panels 40 to the bottom of the patio pond 10. Typically, the pond will be resting on the ground and the bottom portion 48 of the membrane 18 will be supported on the ground itself. As can readily be perceived, the membrane 18 forms the enclosed water tight volume 20 which can be filled with water to form the pond. Fish, water lilies or the like can be stocked in the pond as desired.

Figure 4:
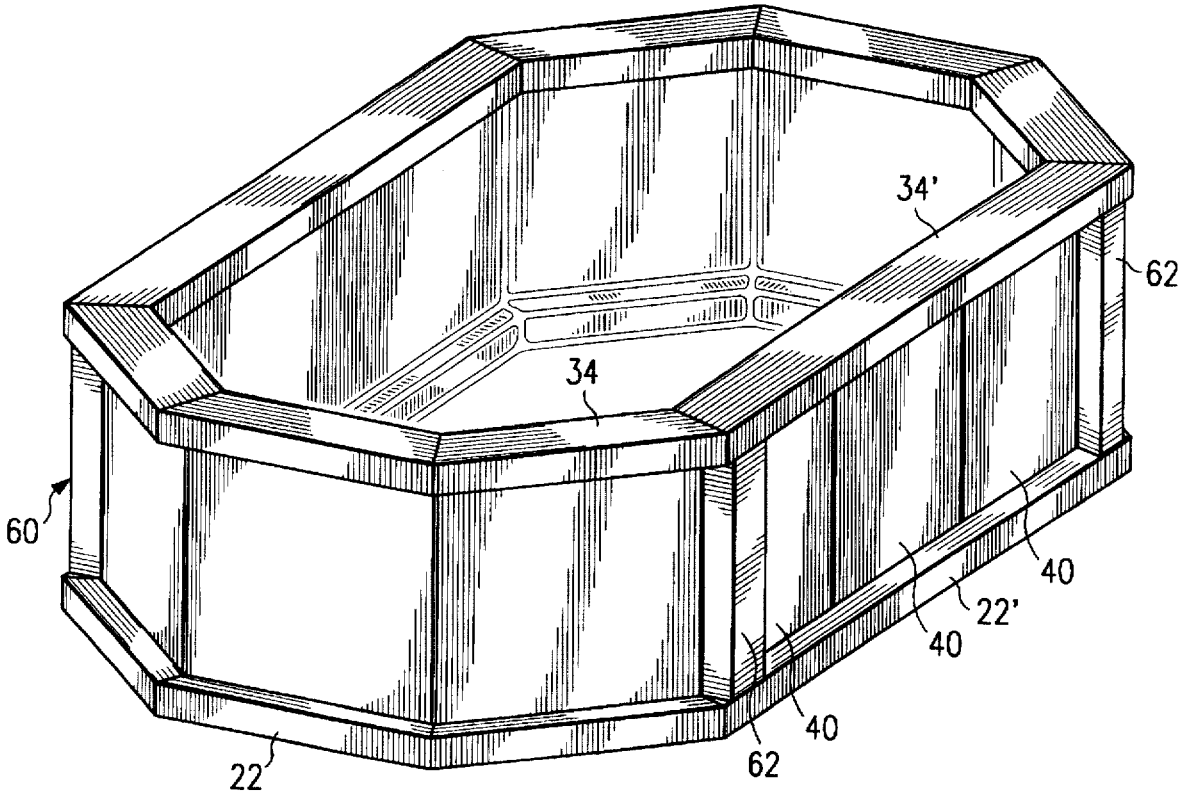
FIG. 4 is a perspective view of a modified patio pond.

With reference now to FIG. 4, a patio pond 60 forming a first modification of pond 10 is illustrated. The ponds are identical with the exception that two sides of pond 60 have boards 22' and 34' which are longer than other boards and which can mount three separate square panels 40 between the notches therein. This provides a larger pond than pond 10. The pond 60 can also be provided with vertical supports 62 which extend between boards 22' and 34' at the ends thereof to provide additional wall support for the pond. The vertical supports 62 can be secured to the boards 22' and 34' by any suitable mechanism, such as glue, screws, nails or the like. However, preferably the supports are secured to boards 22' and 34' by the tapered keys described above.

The boards 22 and 34 are preferably formed of wood, but can be made of other suitable material, such as plastic, metal, concrete or the like. For example, the boards can be made of cedar having a width of 3¼ inches and a height of 1¼ inches. The notches 32 and 38 can be ⅝ inch deep. The wood can be made from 2×4 smooth western red cedar, incense cedar or redwood. The notch 32 can be 0.359 inch wide. The notch 38 would be slightly wider to accommodate the membrane 18 and could be, for example, 0.563 inch wide. While not necessary, the notches 28 to receive the tapered keys 26 are preferably on the lower surface 36 of the boards 34 and lower surface 50 of boards 22 so that they are hidden from sight. Also, the upper edges of each of the boards 34 on the top can be radiused, as can be the outer edge on the upper surface of the boards 22 of the bottom 12 where they would be most visible. The panels 40 can be common one foot square ceramic tiles, concrete tiles, marble, wood panels or any other suitable material. The membrane can be of PVC, for example PVC having a thickness of 20 mils.

As can be understood, the patio pond is formed of inexpensive and common materials and can be easily assembled without use of fasteners, essentially without any tools whatsoever except for a hammer to hammer the keys 26 into the notches 28. It is sufficiently compact to be perfect for a patio, deck, balcony, garden room, courtyard or atrium. It is suitable for both indoor and outdoor use. It can be readily disassembled and moved to another location. If the membrane 18 fails due to accident or exposure, it can simply be replaced by a new membrane with the remainder of the pond being reusable. Because of its knock down construction, the pond can be shipped in a compact, cost efficient package, further reducing costs. Because no holes or other modifications of the panels 40 are needed, a wide variety of panels can be used to provide pleasing appearances to the exterior of the pond.

Although a single embodiment of the invention has been illustrated in the accompanying drawings, and described in the foregoing detailed description, it will be understood that the invention is not limited to the embodiment disclosed, but is capable of numerous rearrangements, modifications and substitutions of parts and elements without departing from the scope and spirit of the invention.

I claim:

1. A pond for holding water, comprising:

a base formed of a plurality of boards secured end to end to define an enclosed perimeter, each of the boards having an upper surface with a notch formed therein;

a top formed of a plurality of boards secured end to end to define an enclosed perimeter, each of the boards having a lower surface with a notch formed therein;

a wall formed by a plurality of discrete rigid panels, each panel having a linearly extending lower edge and a linearly extending upper edge, the lower edge received in the notch in a board in the base and the upper edge received in the notch in a board in the top; and a flexible, waterproof membrane secured between the upper edge of each of the panels and the notches in the boards of the top in which the panels are received about the enclosed perimeter, each of said panels having an inside surface, the membrane extending along the inside surfaces of the panels to form an enclosed volume to receive water.

2. The pond of claim 1 wherein the wall further includes at least one board extending vertically and secured between a board in the base and a board in the top.

3. The pond of claim 1 wherein each of the boards of the top and base have a tapered notch formed in the ends thereof, the pond further including tapered keys engaging the boards at the tapered notches to secure the boards end to end.

4. The pond of claim 1 wherein the boards are formed of wood and the panels are formed of ceramic tile.

5. The pond of claim 1 wherein the membrane is formed of PVC.

6. The pond of claim 1 wherein the panels are square.

7. The pond of claim 1 wherein each of the boards has ends abutting adjacent boards, the ends being mitered.

8. The pond of claim 1 wherein the panels are about one foot square and have a thickness of 11/32 inches, the notches in the boards of the base being 0.359 inches wide and the notches in the boards of the top being 0.563 inches wide.

9. The pond of claim 1 having eight boards in the top and eight boards in the base.

10. A method for assembling a pond for holding water, comprising the steps of forming a base by positioning a plurality of boards end to end and securing the boards to each other to define an enclosed perimeter, each of the boards having an upper surface with a linearly extending notch formed therein;

forming a top of a plurality of boards positioned end to end and secured to each other to define an enclosed perimeter, each of the boards having a lower surface with a linearly extending notch formed therein;

placing a discrete rigid panel having a linearly extending lower edge, a linearly extending upper edge and inner surface in the notch with the lower edge of the panel in the notch in each of the boards in the base to form a wall;

laying a flexible waterproof membrane over the upper edge of each of the panels and draping the membrane along the inner surface of the panels to form an enclosed volume; and fitting the notches of each of the boards of the top over the membrane and upper edge of the panels to complete assembly of the pond.

* * * * *